United States Patent [19]

Radtke

[11] Patent Number: 4,825,642

[45] Date of Patent: May 2, 1989

[54] PLUGGED INSPECTION OPENING

[75] Inventor: Leland J. Radtke, Gatlinburg, Tenn.

[73] Assignee: United Technologies Corporation, Hartford, Conn.

[21] Appl. No.: 163,350

[22] Filed: Mar. 2, 1988

[51] Int. Cl.[4] ..... F01D 25/00; F02C 7/00

[52] U.S. Cl. ..... 60/39.33; 415/118

[58] Field of Search ..... 60/39.33, 705; 415/118, 415/201; 220/260; 356/241

[56] References Cited

U.S. PATENT DOCUMENTS

| | | | |
|---|---|---|---|
| 1,495,268 | 5/1924 | Steidel . | |
| 3,362,160 | 1/1968 | Bourgeois | 415/118 |
| 3,936,217 | 2/1976 | Travagline et al. | 415/118 |
| 3,994,604 | 11/1976 | Visser | 403/15 |
| 4,011,017 | 3/1977 | Feuerstein et al. | 415/118 |
| 4,406,580 | 9/1983 | Baran | 415/118 |
| 4,668,162 | 5/1987 | Cederwall | 415/115 |

*Primary Examiner*—Louis J. Casaregola

*Attorney, Agent, or Firm*—Edward L. Kochey, Jr.

[57] ABSTRACT

Plug 40 inserted in inspection opening 20 has an internal surface 42 conforming to interior surface 16 when properly oriented. Arm 46 secures the plug in the oriented position and acts against tapered boss 30 for removal of the plug.

2 Claims, 1 Drawing Sheet

PLUGGED INSPECTION OPENING

The Government has rights in this invention pursuant to a contract awarded by the Department of the Air Force.

TECHNICAL FIELD

The invention relates to a plugged opening in a gas turbine engine and in particular to an easily removed plug.

BACKGROUND OF THE INVENTION

Safe operation of a gas turbine engine dictates that the engine be periodically inspected. Accordingly, plugged openings are provided in the casing for borescopic insertion providing for inspection of interior components.

The plug must be secure during normal operation with a seal sufficiently snug to prevent leakage. Such a plug, however, tends to bind after engine operation thereby often requiring special pulling tools for plugs. Particularly with aircraft engines such operation may at times be carried out at locations where the special tools are not available.

The interior surface of the plug must be smooth and aligned with the interior casing surface to avoid airflow disturbances which would have a negative effect on the flow distribution entering a compressor or turbine. Threaded openings are expensive, they create stress concentrations, and they present great difficulties in properly aligning the interior surface with the surface of the casing.

SUMMARY OF THE INVENTION

A gas turbine engine casing has a cylindrical opening therethrough for inspection purposes. This opening is often nonradial and therefore skewed with respect to the interior surface sometimes because of access interference of surrounding equipment. A plug includes a cylindrical plugging portion which has an interior surface aligned with the casing when the plug is in a particular aligned direction. The plug has on its outer end an arm extending from the center of the plug with a bolt receiving opening therein so that the plug may be bolted in the aligned condition. The plug also includes a circumferential seal around the plugging portion in interference sealing relationship with the opening.

A tapered boss is located on the casing immediately adjacent to the plug which has a tapering surface tangent to the outer surface of the casing at one location and tapers away therefrom. This boss is located within the radius defined by the arm on rotation of the plug within the opening. Accordingly, the arm after being unbolted may be rotated with a camming action against the taper causing the plug to extract itself from the opening without the use of special tools.

DESCRIPTION OF THE PREFERRED EMBODIMENT

Figure 1:
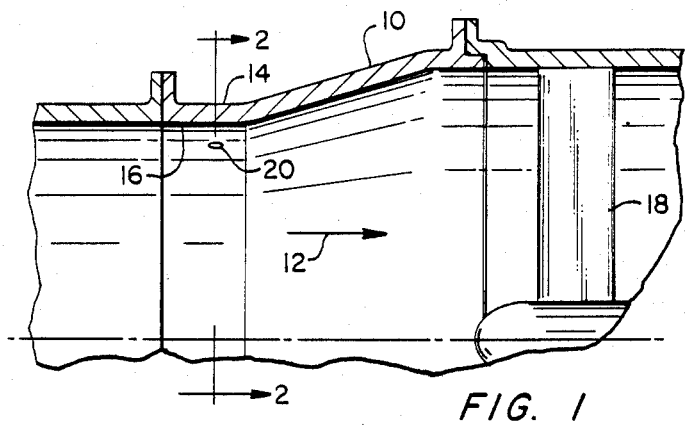
FIG. 1 is a sectional longitudinal view of a portion of the engine casing at the compressor inlet showing the plug location.
Figure 2:
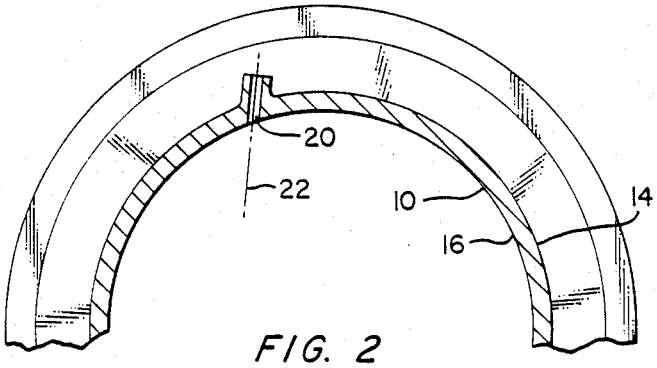
FIG. 2 is a section of transverse section through the casing showing the plug location.
Figure 3:
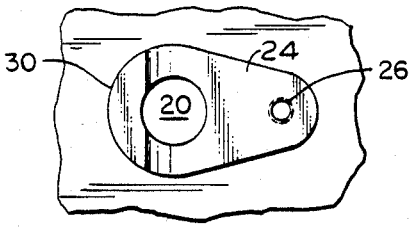
FIG. 3 is a plan view of the opening in boss.
Figure 5:
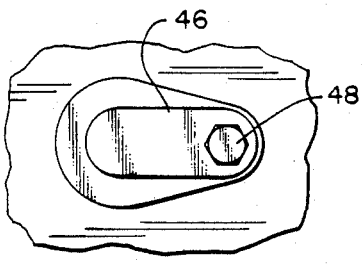
FIG. 5 is a plan view of the opening with the plug installed.
Figure 4:
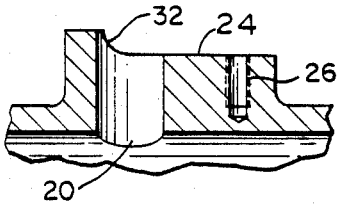
FIG. 4 is a sectional view through the opening in boss.
Figure 7:
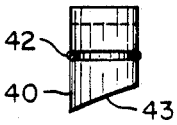
FIG. 7 is an elevation of the plug 90 degrees from the FIG. 6 view.
Figure 6:
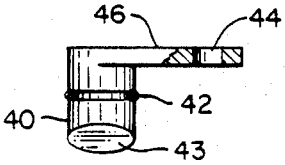
FIG. 6 is an elevation of the plug.

A casing 10 confining airflow 12 into a gas turbine compressor has an external surface 14 and an internal surface 16.

The airflow is conveyed to the compressor past supporting struts 18. In order to inspect these struts and other internal components, an inspection opening 20 in the form of a cylindrical opening is provided. This permits entry of a borescope for inspection. The centerline 22 of the opening is not radial but is skewed therefrom since external apparatus interferes many times with a radial opening.

Surrounding the opening 20 is a substantially planular surface 24 with a threaded bolt hole 26 located nearby. A tapered boss 30 has a uniformly sloping surface 32 which is tangent to surface 24. A plug 40 has a sealing 0 ring 42 which is in interference fit contact with opening 20 when the plug is installed. The plug has a skewed interior surface 43 which conforms with the interior surface of the casing when the plug is in a particular aligned condition. A bolt receiving opening 44 located within radially outwardly extending arm 46 permits bolt 48 to pass therethrough securing the plug in place by engagement of the bolt within opening 26.

For removal of the plug the bolt 48 is removed and the arm rotated whereby the inner surface of the arm operates in a camming action against surface 32 of the boss to remove the plug without special tools.

I claim:

1. An inspection plug apparatus for a gas turbine engine casing, said casing having an inside contour:

a cylindrical inspection opening through said casing;

a plug including a cylindrical plugging portion slideable within said opening, said plug having an inside end and and outside end;

said plugging portion having an inside surface conforming to the inside contour of said casing in one alignment position;

an arm radially outwardly extending from the center of said plug on the outside end of said plugging portion;

orientation means for aligning said arm in said one alignment position;

a circumferential seal around said plugging portion in interference sealing relation with said opening;

a tapered boss on said casing surrounding a portion of said opening, said boss having a surface tangent to the surface of said casing and tapering away therefrom; and said tapered boss being within the radius defined by said arm on rotation of said plug within said opening.

2. An apparatus as in claim 1:

said orientation means comprising a threaded opening in said casing, a bolt receiving opening in said arm, and a bolt securing said arm through said bolt receiving opening to said threaded opening.

* * * * *